United States Patent [19]

McInerney

[11] Patent Number: 4,593,654

[45] Date of Patent: Jun. 10, 1986

[54] COMBUSTION AND FEEDWATER CONTROLLER FOR A FLASH BOILER

[75] Inventor: Michael J. McInerney, Highland Park, Ill.

[73] Assignee: Vapor Corporation, Chicago, Ill.

[21] Appl. No.: 656,093

[22] Filed: Sep. 28, 1984

[51] Int. Cl.[4] ..... F22D 5/26

[52] U.S. Cl. ..... 122/451.2; 122/446; 122/448 R; 236/24.5; 236/25 R

[58] Field of Search ..... 122/447, 448 R, 448 S, 122/451.2, 446; 126/350 R, 351; 236/24.5, 25 A, 25 R, 21 R; 251/75, 122

[56] References Cited

U.S. PATENT DOCUMENTS

| | | | |
|---|---|---|---|
| 4,346,835 | 8/1982 | Trotter et al. | 122/448 R X |
| 4,429,682 | 2/1984 | Huang | 122/448 R X |
| 4,431,132 | 2/1984 | Edmundson et al. | 122/447 X |
| 4,505,253 | 3/1985 | Mizuno et al. | 126/351 |

*Primary Examiner*—Albert J. Makay
*Assistant Examiner*—Steven E. Warner
*Attorney, Agent, or Firm*—Francis J. Lidd

[57] ABSTRACT

A feedwater controller for a flash type water tube boiler wherein feedwater flow through steam generating coils heated by combustion gases is compensated and adjusted, in order to provide proper combustion heat input over a broad range of boiler operating pressures and feedwater temperatures. Flowing feedwater affects combustion heat input through predetermined variations in fuel and air input to the boiler's burner. As disclosed, the first embodiment utilizes temperature and pressure compensating gates in a cylindrical orifice containing a spherical flow control member. Fuel/air control of the generator is provided through movement of the flow control member due to the forces induced by flowing feedwater. In an alternate embodiment, utilizes a piston in the feedwater flow path having a slotted cylindrical metering orifice attached thereto. Internal of the cylindrical orifice is a cooperating temperature compensated helical flow control member. Feedwater flow adjustments over a wide range of feedwater temperature is provided.

3 Claims, 7 Drawing Figures

COMBUSTION AND FEEDWATER CONTROLLER FOR A FLASH BOILER

BACKGROUND OF THE INVENTION

This invention relates generally to coil boilers of the flash type, and more particularly to those where the coil arrangement is "straight through", wherein all heated coils are arranged to introduce feedwater at one end and exit steam and water at the other. This type of boiler is highly responsive to demand for steam, and quickly responds to varying steam flow demands as well as changes in required steam pressure. Rapid response is due to the relatively small amount of water undergoing heating within the coils at any given time, a feature which, in addition to the previously indicated advantages, provides a relatively safe boiler since high pressure steam and/or water vapor exists in only a small portion of the heated coils.

However, the highly responsive nature of these boilers requires extremely close control of the coil feedwater input. Close feedwater control is required due to the extremely small amounts of water undergoing the transition from liquid to vapor state in producing steam, and the relatively small mass of the heated coils. In addition, the boiling internal of the coils can involve essentially all of the known boiling modes, i.e. incipient, nucleate, and transient film boiling.

The need for close feedwater control is further exacerbated by applications of these units wherein rapid changes in demand and/or required pressure are commonly encountered. Under these conditions, if feedwater inputs to the coil are not precisely matched to the output for demand, coil damage due to either lack of a continuum of flow and maintenance of proper control of dissolved feedwater solids, or overheating due to complete absence of water will occur. In any case, it is necessary to maintain certain minimum flows at maximum output pressures and prevent excessive boiler feedwater flow at reduced demands and pressures, or any combination of these operating conditions.

Prior approaches of feedwater control in flash boilers are disclosed in U.S. Pat. Nos. 2,735,410, 3,425,622, and 3,532,028, each hereby fully incorporated by reference. These approaches, while providing reasonably acceptable boiler operation, suffer from the common disadvantage of relatively narrow operating ranges of boiler pressure and steam flow or output. Although these units compensate for mass flow variations by decreased firing as feedwater temperature increases, compensation for feedwater enthalpy is not provided. Boiler operation over a usually encountered feedwater temperature increase is therefore unsatisfactory, due to generating superheated steam.

This difficulty requires that each boiler or steam generator application be equipped with a "tailored" controller flow characteristic, in order to prevent the above mentioned difficulties.

It is therefore an object of this invention to overcome the deficiencies of existing feedwater controllers by providing a feedwater/combustion controller having a wide dynamic range of boiler operating temperatures, pressures, and flow rates.

It is a further object of this invention to provide a feedwater controller for a flash type steam generator wherein compensation for the variations in enthalpy of delivered steam and/or feedwater is provided.

It is an additional object of this invention to provide a feedwater controller for a flash type coil steam generator wherein minimum and maximum feedwater flows over a wide range of operating pressures and temperatures, provides increased coil life through maintenance of minimum feedwater flows and prevention of coil burnout.

SUMMARY OF THE INVENTION

Boilers of the type controlled by the invention disclosed typically operate over a pressure range of 10 to 2800 pounds per square inch gauge (PSIG) and feedwater temperatures of 40° F. through 340° F. Under these conditions, the enthalpy of a pound of delivered steam at the required output pressure and temperature varies substantially. Other variations such as combustion efficiency, and changes in feedwater enthalpy due to variations in return water from the steam separator, also affect the available heat from the boiler at extreme ends of the operating ranges.

However, applicant has discovered that if a boiler output of 80% steam and 20% water carryover to the separator is maintained with cold feedwater, and 90+ steam and 5+% water with hot water, the objectives of adequate coil life over the above mentioned operating and demand ranges can be attained. In order to achieve this output over the range, compensation in the feedwater control is required. Applicant's discovery indicates that due to particular characteristics of the flash type coil boiler, temperature compensation, that is, increased feedwater flow for high temperature feedwater is required in order to prevent "drying out" coils. Greater available heat from the combination of increased feedwater enthalpy and constant available heat reduces coil life. Also, a separate pressure correction, i.e. increasing feedwater flow with pressure in order to accommodate a decreasing steam enthalpy in the higher pressure range is required.

Applicant's discovery can be demonstrated by the following "typical" examples of generator operating conditions. Typical operating conditions demonstrate difficulties encountered with existing feedwater flow sensing devices; As shown below, the heat absorption characteristics of feedwater encountered in generating steam require close control of fuel input in the range of steam generator applications encountered.

| Temperature Compensation | |
|---|---|
| | Va-Power Boiler 100 BHP Equivalent to 3450 LBS/HR Steam From and at 212° F. |
| Feedwater flow = 6.80 Gallons per minute at 40° F. | $W_s$ (steam flow) = 2840 lbs/hr @ 100 PSIA |
| H (feedwater heat content) − 8 BTU/LB | H (enthalpy added to feedwater) = 1187.2 − 8 = 1178.2 BTU/LB |
| W (feedwater mass flow) = 3408 LBS/HR (8.3451 LBS/GAL) | $H_s$ (enthalpy or heat content of produced steam) = 1187.2 BTU/LB |
| Fuel input to generator $Q_f$ = 4,349,992 BTU/HR | $Q_s$ (heat in steam generator) = 3,347,500 BTU/HR (100 BHP) |
| TRAP WATER DISCHARGE, SEPARATED FROM GENERATED STEAM | |

-continued

| | |
|---|---|
| Water Flow From Trap | $W_f$ = 568 LBS/HR |
| Heat Content of Trap Flow | $H_f$ = 298.7 BTU/LB |
| Heat Transferred in Trap Flow | $Q_f$ = 165,118 BTU/HR |
| Net Heat Transferred to Trap Flow | $H_f$ = 298.7 − 8 = 290.7 BTU/LB |

However, if the feedwater temperature increases to 340° F., a typical operating condition, the following operation is encountered with currently used controllers such as disclosed in U.S. Pat. No. 3,452,622.

| | Va-Power Boiler 100 BHP, equivalent to 3450 LBS/HR steam from and at 212° F. |
|---|---|
| Feedwater Flow 6.8 gpm at 340° F. | $W_s$ = 3168 LBS/HR |
| Feedwater heat content H = 311.3 BTU/HR W = 3041 LBS/HR (7.4532 #/gal) Fuel heat into Generator $Q_f$ = 3,881,498 | $Q_s$ = 2,775,271 BTU/HR |
| TRAP FEEDWATER DISCHARGE | |
| Water Flow from Trap | $W_f$ − 0 LBS/HR |
| Trap Heat Flow | $Q_f$ = 0 BTU/HR |

Since the required evaporation rate W, which is equal to 3168 LBS/HR, is now more than the partially compensated feedwater rate of 3041 LBS/HR, generated steam will be superheated, a condition resulting in coil deterioration and short life.

If the invention disclosed here is applied however, the following operating conditions will be achieved;

| | Va-Power Boiler 100 BHP equivalent to 3450 LBS/HR Steam from and at 212° F. |
|---|---|
| Feedwater Flow 6.80 gpm at 340° F. H = 3.113 BTU/LB W = 3041 LBS/HR (7.4538 LBS/GAL) Fuel Oil $Q_f$ = 3,374,922 | $W_s$ (Steam output) = 2797 LBS/HR @ 100 PSIA H = 1187.2 BTU/LB *Net H = 1187.2 − 311.3 = 875.9 BTU/LB $Q_s$ = 2,449,892 BTU/HR (73.2 BH) |
| TRAP DISCHARGE | |
| $W_f$ = | 244 LBS/HR 8% of $W_s$ (Steam Flow) |
| $H_f$ = | 298.7 BTU/LB |
| Net $H_f$ = | 298.7 − 311.6 = −12.6. BTU/LB |
| $Q_f$ = | −3074 BTU/HR |

As shown above, incorporating the concepts of the invention disclosed here results in reducing the generator firing rate, maintaining trap flow, and avoiding operating maintaining the generator in the superheated steam region. The control disclosed therefore, will maintain satisfactory generator operation over the range of 40°-340° F. feedwater temperature.

Similarly, if feedwater temperature is held constant at 180° F., and generated steam pressure is increased from 100 PSIA to 2708 PSIA, the following conditions occur when utilizing a controller such as disclosed in U.S. Pat. No. 3,452,622;

At 100 PSIA;

| | Va-Power Boiler 100 BHP, 3450 LBS/HR Steam From and at 212° F. |
|---|---|
| Flow - 7.26 gpm Feedwater 180° F. h = 148 BTU/LB w = 3525 LBS/HR (8.0969 LBS/GAL) | $W_s$ = 2820 LBS/HR @ 100 PSIA $H_s$ = 1187.2 BTU/LB @ 100 PSIA $h_s$ = 1187.2 − 148 = 1039.2 BTU/LB |
| Fuel $Q_f$ − 4,470.866 | $Q_s$ = 3,347,500 BTU/HR (100 BHP) |
| TRAP DISCHARGE | |
| $W_f$ = | 705 LBS/HR |
| $H_f$ = | 298.7 BTU/LB |
| $Q_f$ = | 106,244 BTU/HR |
| Net $H_f$ = | 298.7 − 148 = 150.7 BTU/LB |

At 2708 PSIA:

| | Va-Power Boiler 100 BHP, 3450 LBS/HR Steam from and at 212° F. |
|---|---|
| Flow = 7.26 gpm Feedwater 180° F. H = 148 BTU/LB W = 3525 LBS/HR (8.0969 LBS/GAL) | $W_s$ = 3752 LBS/HR @ 2708 PSIA $H_s$ −1068.5 BTU/LB |
| Fuel $Q_f$ = 4,470,866 | Net $H_s$ = 1068.5 − 148 = 920.5 BTU/LB $Q_s$ −3,453,744 BTU/HR |
| TRAP DISCHARGE | |
| $W_f$ = | 0 $H_f$ = 758.5 BTU/LB; Net $H_f$ = 758.5 − 148 = 610.5 BTU/LB; $Q_f$ = 0 |

Note that again the evaporation rate exceeds the feedwater pumping rate, resulting in generator operation in the superheat region.

However, if the compensated control of the invention is employed, the following operation is achieved;

At 2708 PSIA;

| | |
|---|---|
| Flow - 7.26 gpm Feedwater 180° F. H = 148 BTU/LB W = 3525 LBS/HR (8.0969 LBS/GAL) | $W_s$ = 3243 LBS/HR $H_s$ 1068.5 BTU/LB Net $H_s$ = 1068.5 − 148 = 920.5 BTU/LB $Q_s$ = 2,985,182 BTU/HR |
| Fuel $Q_f$ = 4,087,175 | |
| TRAP DISCHARGE | |
| $W_f$ = | 282 LBS/HR |
| $H_f$ = | 758.5 BTU/LB |
| Net $H_f$ = | 758.5 − 148 = 610.5 BTU/LB |
| $Q_f$ = | 172,161 BTU/HR |

Again, generator operation with adequate trap flow and no steam superheat has been achieved over the range of 100 PSIA to 2708 PSIA.

Thus, it can be seen that independent flow correction for pressure and temperature is required in order to provide adequate feedwater input over the range of 100 PSIA to 2500 PSIA generator output having typically encountered feedwater temperature inputs from 40° F. to 340° F.

The invention disclosed accomplishes the above through utilizing a flow sensitive orifice having independent flow compensation as functions of temperature and pressure. As disclosed, a ball closure member in the feedwater path affixed to a piston loosely contained in a cylindrical housing provides a means for actuating the fuel and air inputs to the generator through feedwater throttling. Flow compensation is provided through a cylindrical sleeve surrounding the spherical portion of the closure member. The containing sleeve further defines two diametrically opposed channels or cutouts. Internal of each cutout is a segment or gate mounted for pivotal motion. Each section therefore, independently opens or closes channels in the cylindrical member allowing control of liquid mass flow between the ball closure member and the encircling cylinder. As will be discussed in more detail below, each gate is independently adjustable at its ends providing both variable and fixed adjustment of flow intermediate the channel and ball closure member, and thereby through the boiler coils.

In operation, the individual pressure and temperature sensitive elements actuate ends of each cylindrical gate. This arrangement allows increased compensation for temperature at high feedwater flows while maintaining intermediate and low feedwater flow relatively constant. Similarly, the pressure sensitive member provides independent adjustment of feedwater flow for large variations in feedwater flow requirements, i.e. high pressure, low feedwater flows, and intermediate and low pressures.

While the novel inventive feedwater/fuel and air controller will be described in connection with the following preferred embodiment, it will be understood that the preferred embodiment is not intended to limit the invention to that embodiment. On the contrary, the following description is intended to cover alternative approaches, modifications to the preferred embodiments, and equivalents as may be included and/or inferred within the spirit and scope of the invention disclosed, as further defined by the appended claims.

DETAILED DESCRIPTION OF THE INVENTION

Figure 1:
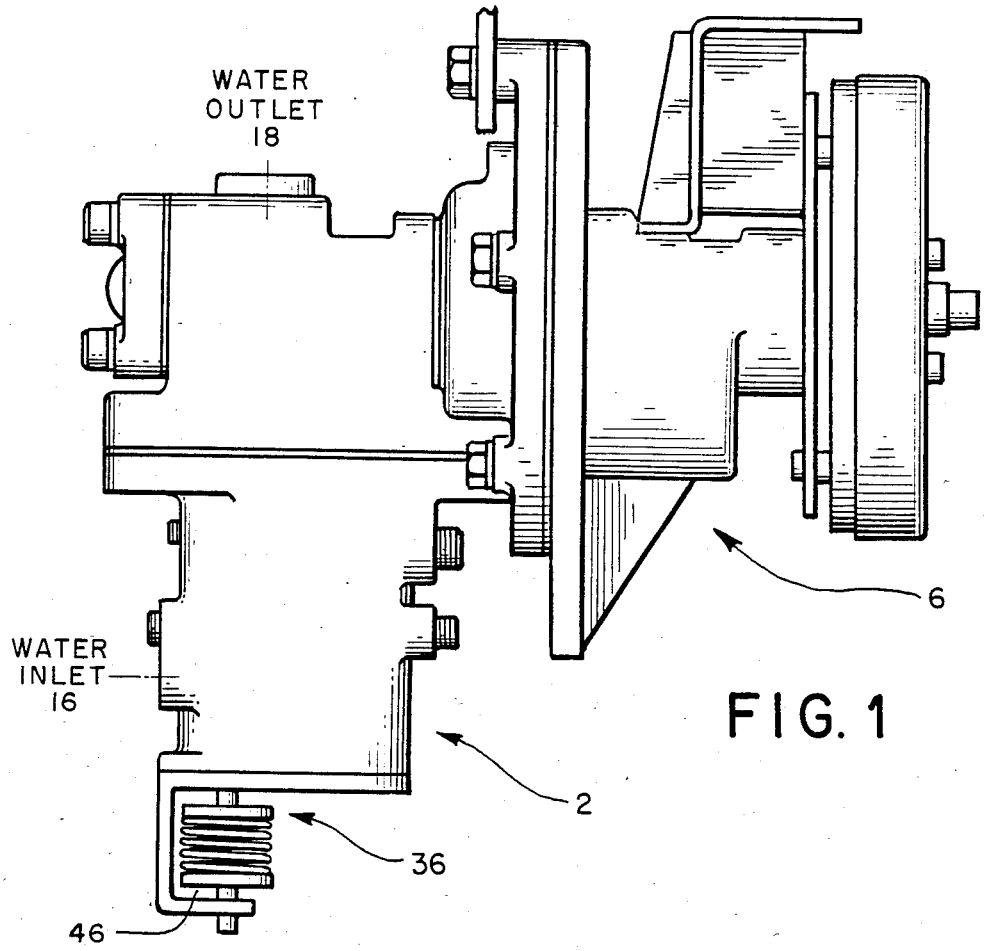
FIG. 1 is a partial tear-away view of the flow controller mounted on a typical boiler servo particularly showing mechanical linkage to the servo operating shaft, with the servo or driven control element shown in phantom.
Figure 4:
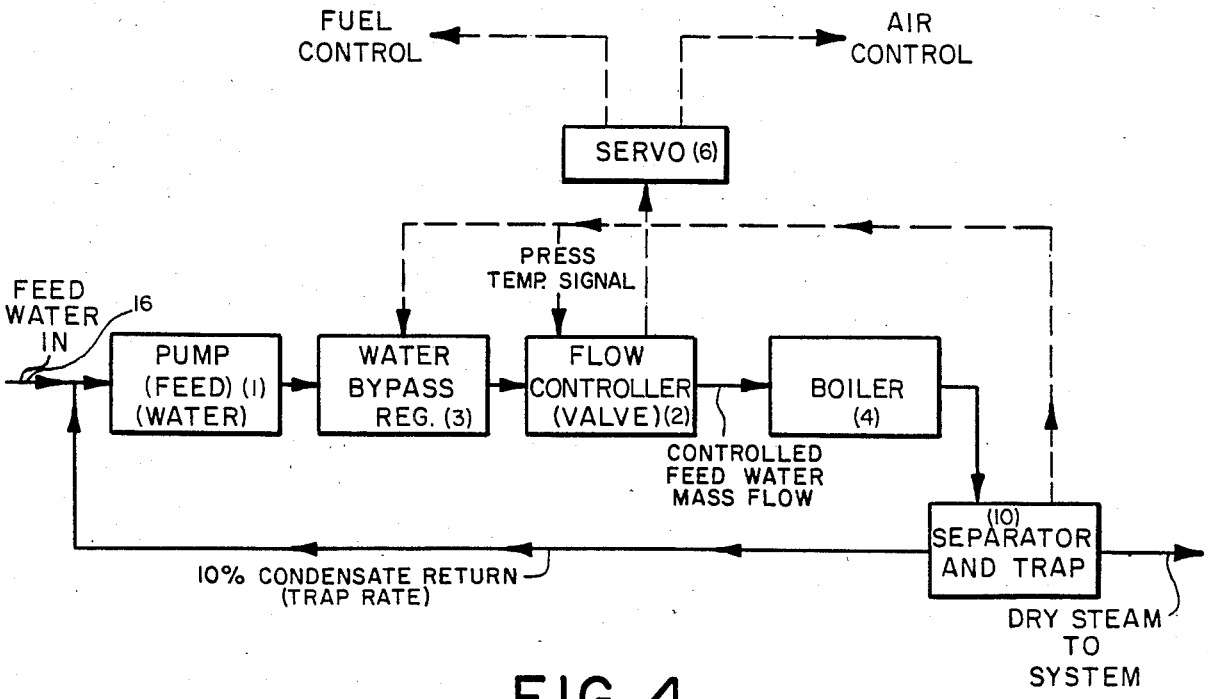
FIG. 4 is a system diagram showing feedwater flow circuit and directly associated control functions.
Figure 2:
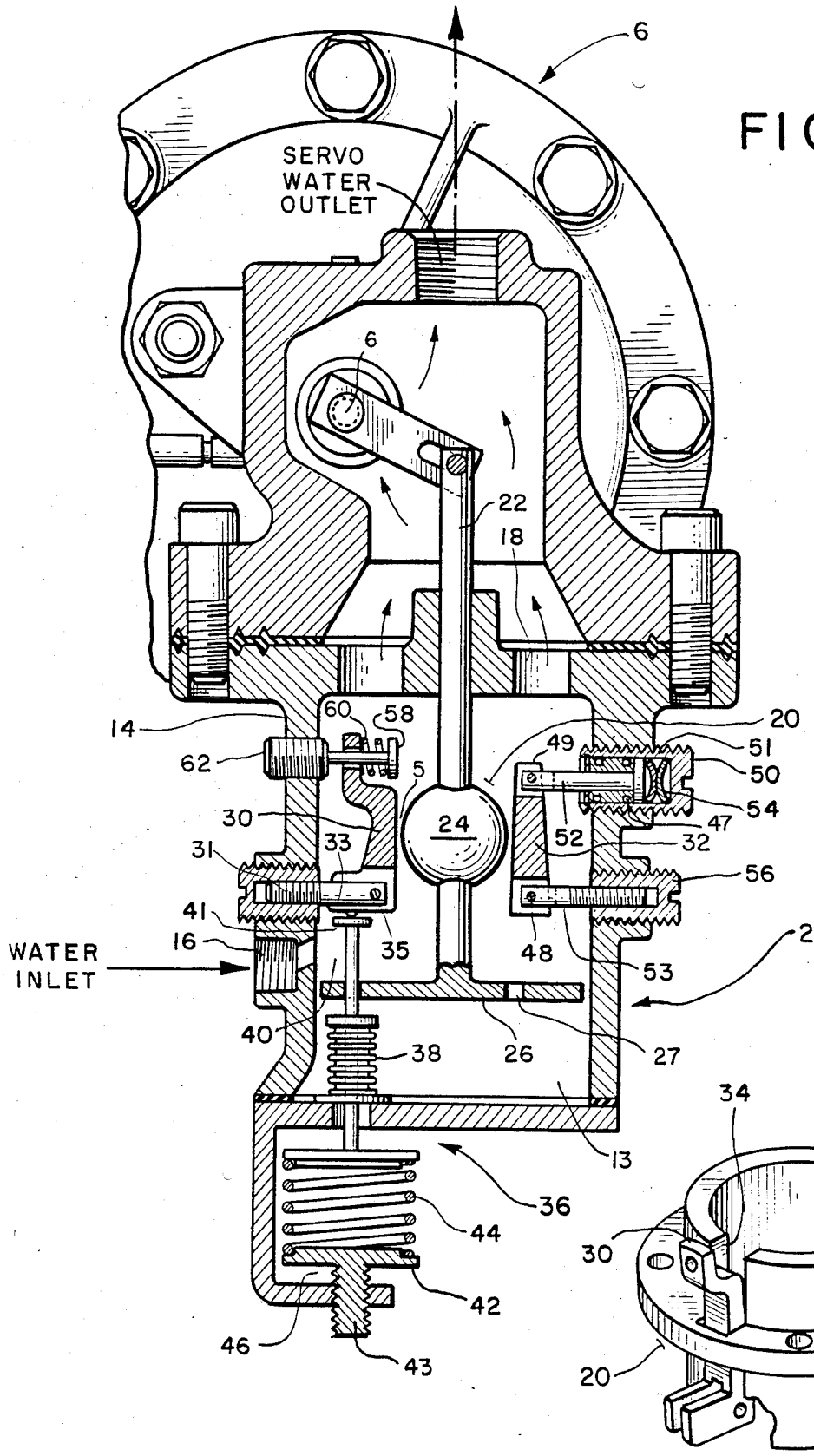
FIG. 2 is a sectional view of the controller in situ showing output shaft connection to a partial section of the servo actuator, particularly showing pressure and temperature compensating elements.

With reference to FIGS. 1, 2, and 4, in illustration of the invention, a flow controller is disclosed which adjusts boiler feedwater mass flow as a function of the feedwater temperature and pressure, providing continuous mechanical adjustment of fuel and air into the boiler combustion system. It should be noted that the initial mass flow adjustment in boiler feedwater is provided by the water bypass regulator 3 (reference FIG. 4). A detailed and thorough description of the bypass regulator function is contained in the above referenced U.S. Pat. No. 2,735,410.

Figure 3:
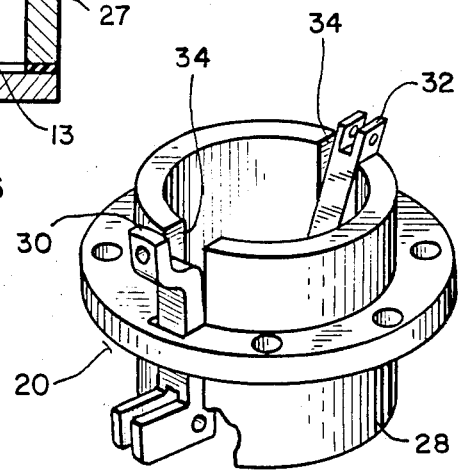
FIG. 3 is a partial view in perspective particularly showing the flow control sleeve and gates.

With particular reference to FIGS. 2 and 3, feedwater from the bypass regulator 3 and pump 1 is admitted to the controller assembly through water inlet 16. The internal chamber 13 of the controller body 14 is therefore completely filled by the feedwater entering the port 16. Flow through the chamber 13 however, is essentially controlled by the flow control assembly 20, comprising a sleeve 28, having two opposing slots or channels 34, for containing control segments or gates 30. Mounted for vertical motion within the sleeve 28 is spherical flow control member 24. Extending from the member 24 at diametrically opposite ends, is a guided actuating shaft 22, and the lower guide and damping piston 26. Vertical motion of the spherical member 24 internal of the sleeve 28 is typically controlled to one and one eighth ($1\frac{1}{8}$) inches for a one inch diameter element 24. The control segments 30 and 32 fit loosely within the channels 34, and are retained by elements to be described below in order to provide adjustable water flow restrictions through the channels 34 and around the spherical member 24.

With particular reference to FIG. 2, the valve body 14 further contains pressure sensing and adjusting elements which in operation, essentially move the pressure and temperature segments, i.e. 32 and 30, so as to adjust flow through the channels 34 as a function of feedwater pressure and temperature.

Pressure flow adjustment around the control element 24 through transverse movement of segment 30, is as follows; The segment 30 is mounted on and contained by an adjusting fork 31, pivotally mounted on 30, utilizing pin 35. The lower end of segment 30 further contains a semi-spherical projection 33 in an abutting relationship with the head 41 of compensating shaft 40. Compensating shaft 40 extends through the lower end of the housing 14, and is in force abutment with a pressure compensating element 38. The extreme lower end 42 terminates the pressure compensating assembly 36 consisting of the above mentioned bellows 38, a bellows preload spring 44, and a lower threaded section 43. The lower threaded section 43 is adjustably journaled in a projection of the housing 14.

In operation, pressure compensation of the flow through cooperating segment 30 and one of the slots 34 is adjusted through force provided by vertical movement of the compensating shaft 40. Initial adjustment or preload is obtained through adjusting precompression on the spring 44 retained by spring retainers 42. Threaded and adjustable elements 43 and 46 control the distances between spring retainers 42, thereby providing initial force on the hemispherical projection of 32. The upper end of 32 is restrained in its pivotal motion around 35 by adjusting pin 58 and a concentrically contained spring 60 acting between the upper end of 32 and an adjusting screw 62.

After initial preload, the pressure adjusting shaft head 41 experiences axial forces due to pressure of the feedwater in the cavity 13 exerted on the compensating bellows 38. Thus, the flow passage provided by the segment 30 lying within the channel 34 is a function of the forces exerted on compensating shaft 40 by pressure bellows 38 opposing the initial forces due to the preload spring 44.

Temperature compensation similarly is achieved by movement of the upper end of control gate 32, cooperating with a slot 34, located approximately 180° from the pressure control slot. Gate 32 is rotatably contained within the slot 34 by pins 48 and 49. The lower end or fixed adjustment 56 consists of a horizontally moving pin 53, threadably engaged in the wall of housing 14. The inner end of 53 contains the above mentioned pin 48. The upper end of gate 32 is pivotally retained by temperature compensating plunger 52, having a pin 49 securing it to the gate 32. The temperature compensating piston 52 is mounted intermediate of a compression spring 47 and temperature compensating discs 54. The discs 54 exert pressure on the head of the pin or plunger 51 in opposition to the compression spring 47, thereby moving the upper end of gate 30 about pin 48 and increasing the flow channel provided by the cooperation of the slot 34 and gate 30, as the temperature of feedwater within cavity 13 increases.

The lower end of spherical element 24, i.e. damping piston 26, contains an orifice 27. The diameter of orifice 27 is adjusted so as to minimize vertical chatter of the flow control assembly due to inadvertent pulsations in feedwater pressure emanating from the pump 4.

In operation, with reference to FIG. 4, and reference U.S. Pat. No. 2,735,410, boiler feedwater mixes with condensate return from steam separator 10 and enters the feedwater pump 1. Pump feedwater enters the bypass regulator 3 and, depending on the delivered steam pressure, passes through the regulator entering the flow control valve 2 of the invention. As indicated above, pump feedwater enters the flow control valve at 16, passes essentially through a flow channel 5 defined by the flow control assembly 20 and surrounding sleeve 28. Flow through this channel is compensated for feedwater pressure and temperature by gates 32 and 30, respectively, as indicated above.

Feedwater flow through the channel 5 around spherical element 24 produces a vertical or upward force on 24 and its associated projection or operating shaft 22 in proportion to feedwater mass flow. The actuating shaft 22 is rotatably attached to fuel and air control elements as partially shown in FIG. 2, providing heat input to the boiler 4, coils through adjustment of fuel and air as a function of the feedwater mass flow. Control elements for controlling fuel and air delivery to the boiler combustion system are actuated by the servo 6, a mechanical force booster. Maintenance of the precise balance of boiler firing through fuel and air control, in proportion to the feedwater flow to the boiler coils, establishes boiler operation for a wide range of steam temperature, pressure, and flow rate.

As shown above, the precise adjustment provided by this invention prevents overfiring and subsequent "drying out" of the boiler coils resulting in substantially increased coil life and greatly enhanced boiler operation.

Figure 5:
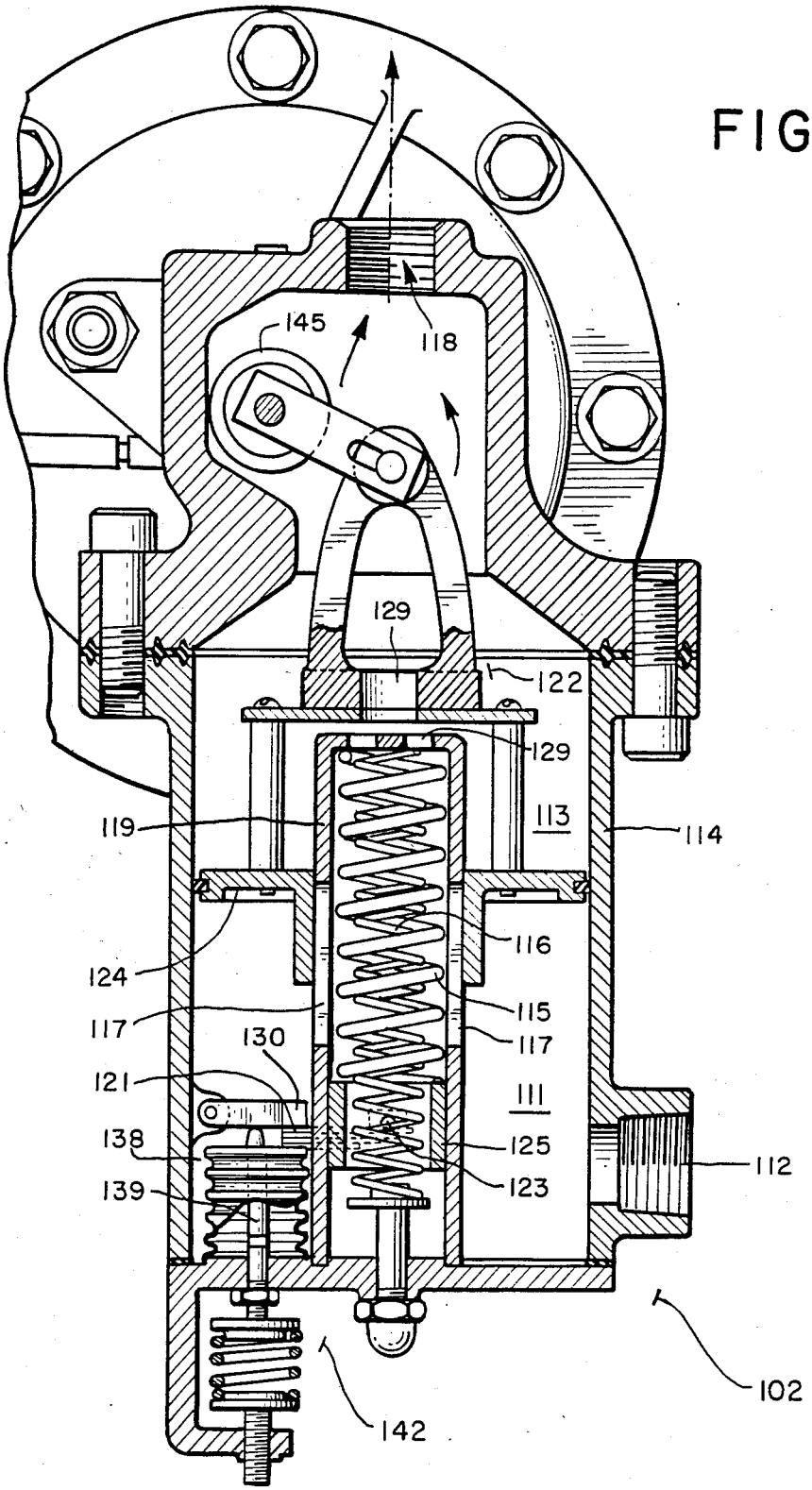
FIG. 5 shows an alternate embodiment of the controller in a view similar to FIG. 2.

An alternate embodiment (reference FIGS. 5, 6, and 7,) provides similar adjustment of the fuel/air ratio as a function of feedwater mass flow through rotary displacement of the input shaft of servo mechanism 6 (reference FIGS. 2 and 5). Since many elements of this alternate embodiment are similar to those of the preferred embodiment, similar numbers utilizing the prefix 1 are used in the FIGS. 6, and 7, whenever new elements are introduced.

Figure 6:
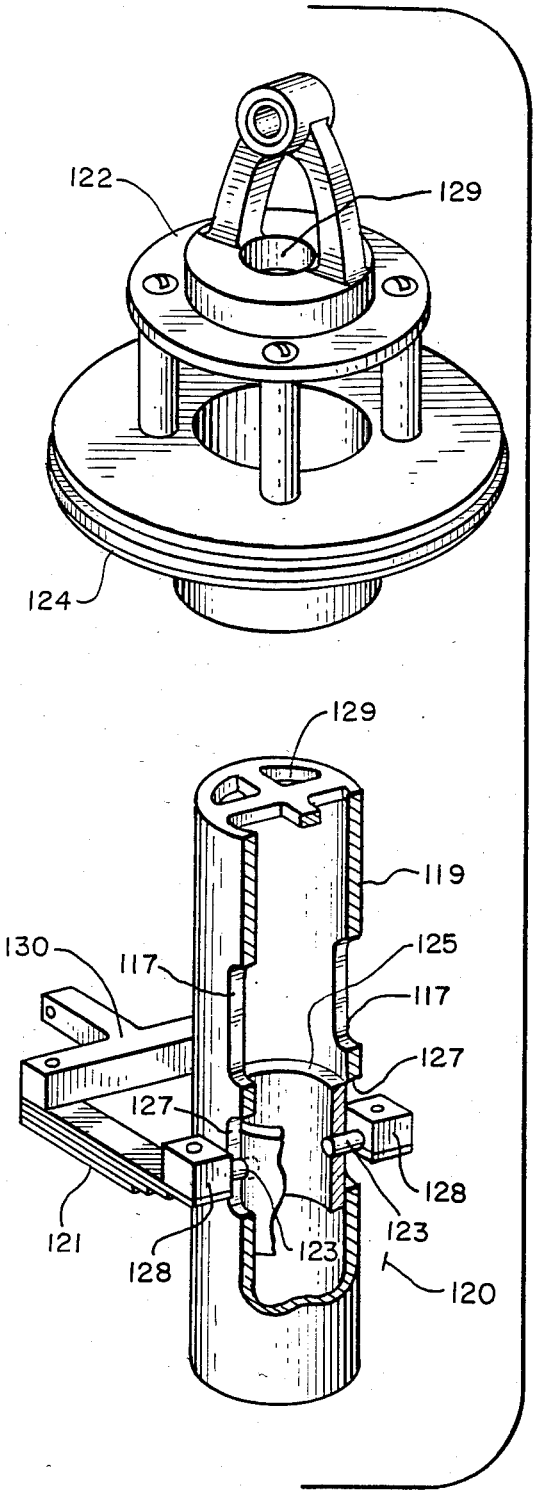
FIG. 6 is a partially exploded view of the alternate embodiment of FIG. 5, particularly showing details of the flow metering, pressure and temperature compensating elements.

The alternate embodiment controller assembly 102 comprises a body 114, having upper and lower chambers 113 and 111, respectively, in fluid communication through an internal port 129, and flow control ports 117. Piston 124 is contained internal the upper chamber 13 for reciprocal motion therein. Centrally located on the piston 124 is a flow control assembly 120 (ref. FIG. 6) and an actuating yoke 122 for operating the arm of the servo mechanism 6 as indicated above. Centrally located in the piston 124, is the metering cylinder 119, a portion of the flow control assembly 120. The metering cylinder 119 further defines longitudinal flow control slots 117, and further contains a helical flow control member 115. Internal of and in sliding relationship with the metering cylinder 119, is a cylindrical orifice adjusting sleeve 125. Vertical translation of the sleeve 125 is achieved through corresponding vertical motion of pins 123, passing through the metering cylinder via vertical adjustment slots 127. Abutting the upper surface of sleeve 125 is the lower end of helical orifice 115. As the upper end of orifice 115 is contained in the flow control cylinder 119, vertical movement of the sleeve 125 will result in compressing 115, thereby reducing the longitudinal intercoil spaces. As the helical member 115 is concentric to the inner surface of the cylinder 119, particularly in the area of flow control slots 117, variation in the longitudinal helical spaces of 115 results in restricting flow area through control slot 117. An additional helical member or spring 116 is internal of and essentially concentric with helical member 115, and has its upper end retained by the upper portion of cylinder 119 adjacent its upper orifice 129. The lower end of spring 116 is mounted for predetermined longitudinal movement relative to the lower surface of chamber 111 by suitable movement adjusting means such as a threaded bolt. The adjusting means serves to establish initial compression of the member 116 which, as described above, varies the longitudinal interhelical spaces and, as described above, serves to initially adjust the flow through control slots 117 when passing through the combined longitudinal interhelical slots of members 115 and 116, and exiting the sleeve outlet orifice 129.

The lower end of compensating assembly 142 is affixed in the lower surface of chamber 111. Adjacent and internal of the lower end of the metering cylinder 119 are the temperature compensating elements 121. As disclosed, bimetal strips 121 act to increase vertical force on the metering spring or element 115 and bias spring 116, moving the metering sleeve 125, thus varying the effective flow area of metering slot 117, and adjusting feedwater flow to the coils of boiler 9.

The pressure compensating assembly 142 further comprises a pressure sensitive bellows 138, and an internal adjusting rod 139. The rod 139 cooperates with the pressure compensating bellows 138 and transmits pressure changes internal of the bellows through movement of the piston 139, to apply an adjusting force to temperature compensator yoke 130. Movement of the flow control metering sleeve 125 is further effected by the temperature compensating bimetal strips 121 through abutment with the pin/block adapters 128 rotatably coupled to the moveable cylinder 125.

This arrangement therefore, provides vertical movement or adjustment of the helical orifice 115 for variations in pressure and temperature of the feedwater contained in either the upper chamber 113 or lower chamber 111 of the controller.

Inasmuch as metering cylinder 119, orifice 115, and associated flow slot 117, are fixed, except for temperature and pressure adjustment in relation to the lower end of chamber 111, movement of the piston 24 relative to the cylindrical metering slots 117, varies fluid flow through chamber 113 in accordance with the location of piston 24 in chamber 113 and the compression of helical members 115 and 116.

Figure 7:
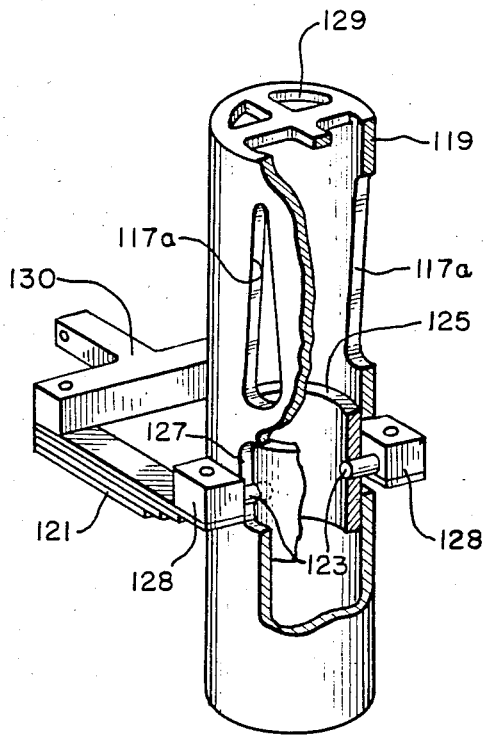
FIG. 7 is a partial perspective view of an alternate construction with partial tear-away to particularly show operation of sleeved flow control members.

As shown in FIG. 7, the flow control slot 117 is a variation of slot 117*a* of FIG. 6. As those skilled in the fluid flow art will readily understand, slot 117*a* provides additional adjustment in feedwater flow. As disclosed, slot 117*a* provides diminishing changes in flow through the slot for corresponding positions of the piston 124. It is submitted that the variation shown as 117*a* is only one of many that will provide additional control in situations where steam rate, pressure, and temperature require specific control adjustments.

In operation, feedwater from the bypass regulator 3 enters the chambers 111 and 113 via water inlet 112. Assuming that the piston occupies the position disclosed in FIG. 5, water flows through the portion of slot 117 located below its engagement with the piston 124, passes through the helical interstices of the orifices 115 and 116, and exits the upper end of the metering cylinder 119 at 129. As indicated, feedwater flow then continues via the upper chamber outlet 118, entering the inlet of boiler 9.

As those skilled in the art will readily recognize, a pressure differential due to the restriction of the flow control assembly 120 acting on the underside of the piston 24, will position the upper yoke 122 as a function of or in proportion to the rate of feedwater flow. The pressure and temperature compensation assemblies 120, and 42, respectively, through vertical movement of the helical orifices 115 and 116, adjust feedwater flow existing 118, so as to adjust feedwater flow for variations in temperature and pressure.

Reciprocation of the piston 124 in housing 114 is, as described above, a function of feedwater temperature, pressure, and flow. These flows are established as indicated earlier by desired boiler steam temperatures and pressures. Since motion of piston 124 is transmitted to the fuel/air adjusting shaft 145 via the piston yoke assembly 122, precise adjustment of the boiler firing rate is attained in accordance with predetermined steam flow at specified temperature and pressure.

The above invention as disclosed, has provided a novel flash generator feedwater/fuel and air controller in the form of two embodiments that fully satisfies the objects, aims and advantages set forth above. While the controller of the invention has been described in conjunction with a specific embodiment, it is evident that many alternatives, modifications and variations will be apparent to those skilled in the flash steam generator art, in the light of the foregoing description. Accordingly, it is intended to embrace all such alternatives, modifications and variations as fall within the spirit and broad scope of the appended claims.

Therefore, I claim:

1. A controller for compensating feedwater flow through coils of a flash type steam generator comprising;

a housing having a feedwater inlet and outlet;

means supplying feedwater to said inlet at a steam pressure-proportional flow rate;

an essentially cylindrical feedwater flow sleeve for containing said feedwater internal said housing and intermediate said inlet and outlet;

a flow responsive control member having an essentially spherical portion concentrically mounted internal said sleeve, said control member and sleeve defining a feedwater flow control orifice;

means mounting said control member for vertical reciprocating movement relative said sleeve thereby establishing flow related positions of said member;

slots in said sleeve adjacent said spherical member defining bypass flow channels, said flow channels intermediate the spherical portion periphery and said slots;

control gates in said slots for containing flow through said channels;

means moving said gates in said channels providing adjustment in control member position for varying feedwater flow through said flow control orifice.

2. The controller of claim 1 further including temperature compensating means adjusting at least one of said flow control gates, providing adjustment of feedwater mass flow as a function of its temperature.

3. The controller of claim 1 further comprising;

pressure responsive means internal said controller housing;

means coupling said pressure responsive means to at least one of said control gates, thus providing pressure compensation for feedwater mass flow through said controller.

* * * * *